US005439061A

United States Patent [19]

Brammer et al.

[11] Patent Number: 5,439,061

[45] Date of Patent: Aug. 8, 1995

[54] ADJUSTABLE SURFACE WELL HEAD CASING HANGER

[75] Inventors: Norman Brammer, Fyvie Turiff; Calum J. B. Dinnes, Aberdeen; Stanley Hosie, Peterhead; Trevor W. J. Park, Aberdeen, all of Scotland

[73] Assignee: ABB Vetco Gray Inc., Houston, Tex.

[21] Appl. No.: 285,577

[22] Filed: Aug. 3, 1994

[51] Int. Cl.[6] ..... E21B 43/01

[52] U.S. Cl. ..... 166/368; 166/381; 166/208; 285/142

[58] Field of Search ..... 166/98, 348, 368, 196, 166/197, 237, 208; 285/142, 143

[56] References Cited

U.S. PATENT DOCUMENTS

| | | | |
|---|---|---|---|
| 4,607,865 | 8/1986 | Hughes . | |
| 4,691,780 | 9/1987 | Galle, Jr. et al. | 166/368 X |
| 4,736,799 | 4/1988 | Ahlstone | 166/348 |
| 4,742,874 | 5/1988 | Gullion | 166/368 X |
| 4,751,965 | 6/1988 | Cassity | 166/348 X |
| 4,759,409 | 7/1988 | Gullion | 166/348 |
| 4,938,289 | 7/1990 | Van Bilderbeek . | |
| 5,002,131 | 3/1991 | Cromar et al. . | |
| 5,163,514 | 11/1992 | Jennings | 166/368 |
| 5,188,181 | 2/1993 | Brammer et al. | 166/368 |
| 5,255,746 | 10/1993 | Bridges . | |
| 5,360,063 | 11/1994 | Henderson, Jr. | 166/348 |

*Primary Examiner*—Ramon S. Britts
*Assistant Examiner*—Frank S. Tsay
*Attorney, Agent, or Firm*—James E. Bradley

[57] ABSTRACT

A surface wellhead system for a subsea well utilizes a two-piece casing hanger. The casing hanger has an inner member that secures to a string of casing that extends from the sea floor to a surface casing head. The outer member of the casing hanger is axially adjustable relative to the inner member and will hold tension in the casing. The outer member lands on a load shoulder in the casing head. An annulus outer seal seals between the exterior of the outer member and the bore of the casing head. An inner seal seals between the inner member and the bore of the outer member.

23 Claims, 6 Drawing Sheets

ADJUSTABLE SURFACE WELL HEAD CASING HANGER

BACKGROUND OF THE INVENTION

1. Field of the Invention

This invention relates in general to offshore drilling for oil and gas, and in particular to a system for tensioning a section of casing extending between a subsea location at the sea floor and a surface wellhead located on a platform at the surface.

2. Summary of the Prior Art

In one type of offshore drilling and completion, the wellhead housing or casing head will be located at the surface on a platform. Lower strings of casing in the well are supported on the subsea floor by a mudline hanger or subsea housing. Subsequently upper strings of casing will be installed to extend from the subsea location to the surface platform. Tension needs to be applied to the upper strings of casing, as well as adjustment made for height differences.

Systems are known for adjusting the length of the upper strings of casing and applying tension to the casing above a subsea location. These systems employ a variety of adjustable load shoulders, including rings mounted to the casing which operate with rotation, rings that mount to the casing and adjust by ratcheting, and others that axially move the casing head shoulder.

SUMMARY OF THE INVENTION

In the invention, a string of upper casing is run through the blowout preventer and surface casing head and latched into the subsea location such as a mudline latch. A two-piece casing hanger will be located at the upper end of the upper string of casing. The two-piece casing hanger has an inner member secured to the string of casing and an outer member that is axially moveable relative to the inner member.

A seal running tool is then lowered over the casing. The seal running tool pushes the outer member downward until its load shoulder engages the load shoulder in the casing hanger. The seal running tool has a conventional casing hanger outer seal that locates between an external seal area on the outer member and the casing hanger. The running tool sets the outer seal and then pulls upward on the inner member to apply tension. The outer member has an inner seal located in its bore that will simultaneously seal against an external seal area on the inner member. The inner and outer seals seal off the annulus surrounding the string of casing. Test passages extending through the outer member and through the outer seal enable test fluid to be applied to the inner seal and outer seal for testing of both seals.

DETAILED DESCRIPTION OF THE INVENTION

Figure 1:
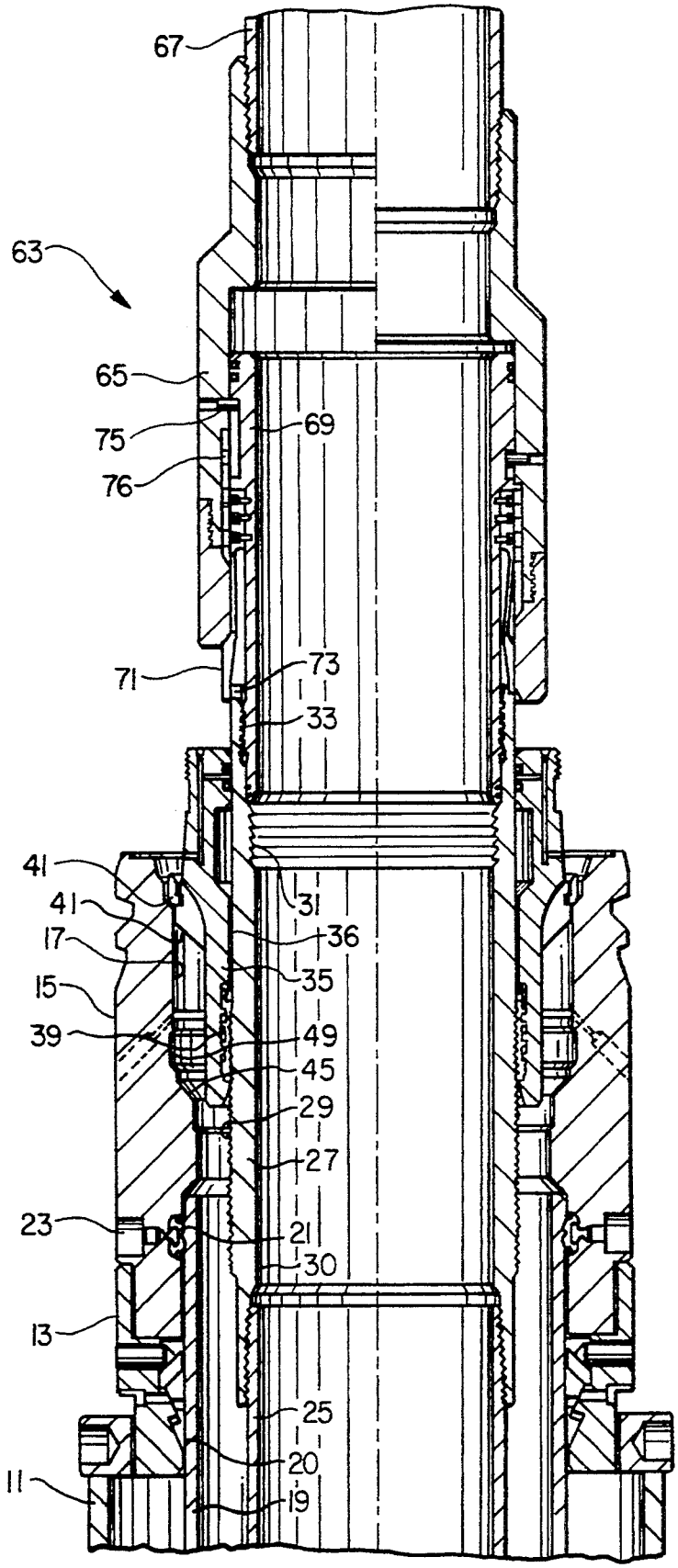
FIG. 1 is a vertical sectional view illustrating a two-piece casing hanger and a casing running tool shown installing the casing in the surface wellhead above a subsea location, the two-piece casing hanger being constructed in accordance with this invention.

Referring to FIG. 1, the left side of the drawing shows the system in a first position and the right side shows the system in a second position. The system includes an outer conductor 11 which extends upward from a subsea location (not shown). The subsea location is at the sea floor and typically comprises a mudline hanger system which is supporting lower casing installed within the well. The outer conductor 11, normally 30 inches in diameter, supports an adapter 13 on its upper end. A casing head 15 is supported on adapter 13. Casing head 15 has a bore 17.

A string of outer casing 19, typically 20 inches in diameter, extends upward from the subsea location. Outer casing 19 is supported by slips 20 of adapter 13. A plurality of segments 21 clamp casing head 15 to grooves in the outer casing 19. Screws 23 are used to tighten the clamp segments 21 in place.

An intermediate casing 25 is shown being installed in FIG. 1. Intermediate casing 25, typically 13⅜ inch diameter, has a mudline latch (not shown) on its lower end that will latch into the mudline hanger at the subsea location. Intermediate casing 25 is run on a two-piece casing hanger which includes an inner member 27. Inner member 27 secures to threads on the upper end of intermediate casing 25. Inner member 27 has external grooves 29 on its outer diameter, which are threads in the preferred embodiment. Inner member 27 is tubular, having a bore 30 that is of the same diameter as the inner diameter of casing 25. A set of lifting grooves 31, preferably threads, is located near the upper end of bore 30. A set of internal threads 33 is located above lifting grooves 31.

Figure 7:
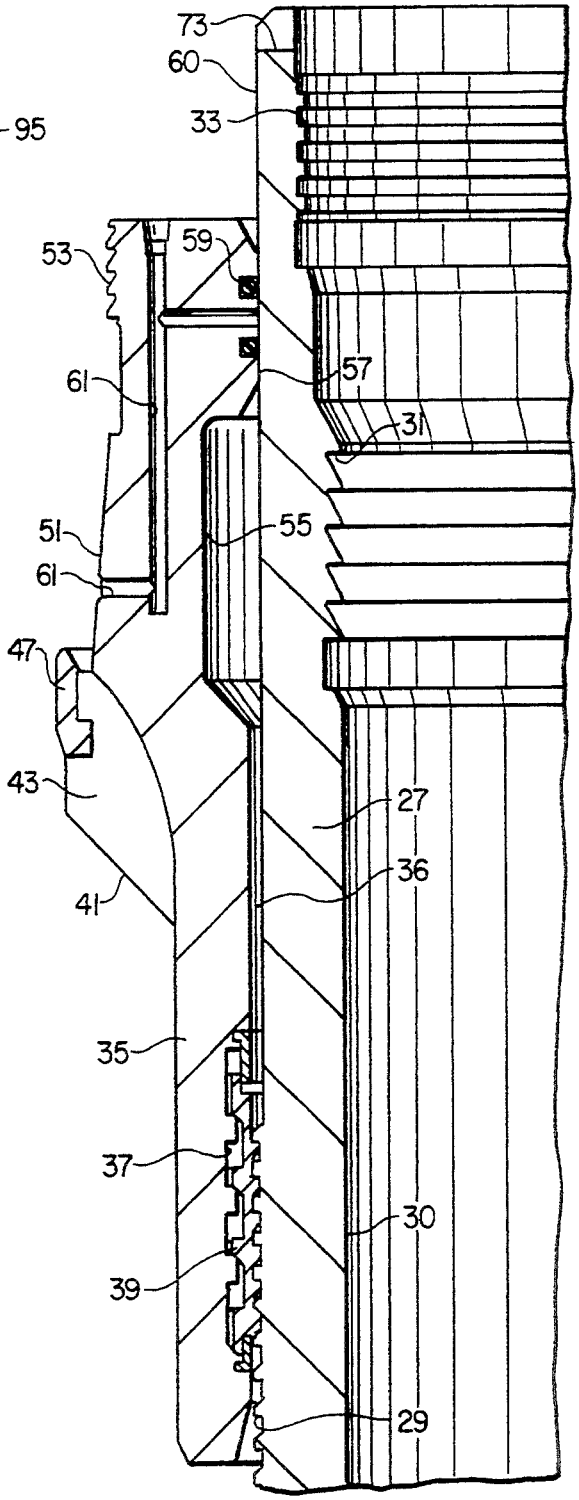
FIG. 7 is an enlarged sectional view illustrating the two-piece casing hanger of FIG. 1.

The other portion of the two-piece casing hanger is an outer member 35. Outer member 35 has a bore 36 that telescopingly receives inner member 27. An engaging means located between outer member 35 and inner member 27 allows axial movement of inner member 27 and outer member 35 relative to each other in one direction, but prevents it in the other direction. The engaging means, as shown in FIG. 7, preferably includes internal shoulders or grooves 37 located in outer member 35. A split latch ring 39 is carried in the internal grooves 37 and has mating shoulders on its outer diameter. Latch ring 39 has threads on its inner diameter which engage the external threads 29 on inner member 27. Latch ring 39 will ratchet to allow upward movement of inner member 27 relative to outer member 35, but not allow downward movement. Latch ring 39 is the same type as shown in U.S. Pat. No. 4,607,865, David W. Hughes, issued Aug. 26, 1986, all of which material is incorporated by reference.

Referring still to FIG. 7, outer member 35 has a downward facing, inclined external landing shoulder 41. Channels 43 are formed through landing shoulder 41 for flowby. Landing shoulder 41 will land on a load shoulder 45 shown in FIG. 1, which is conical, upward facing and formed in bore 17 of casing head 15. A split retainer ring 47 is carried directly above landing shoulder 41. Retainer ring 47 is positioned to be forced out into a recess 49 in bore 17, shown in FIG. 1. Once engaging recess 49, retainer ring 47 will prevent upward movement of outer member 35 relative to casing head 15.

Referring still to FIG. 7, outer member 35 has an external seal area 51 located above retainer ring 47. Seal area 51 in the embodiment shown is a slight taper with a greater outer diameter at the lower end than at the upper end. Seal area 51 will be spaced radially inward from bore 17, defining a clearance or pocket. Locking threads 53 are formed on the outer surface of outer member 35 above seal area 51.

Bore 36 of outer member 35 has an annular recess 55 located above internal grooves 37. A cylindrical land 57 locates above recess 55. Land 55 has a smaller inner diameter than the remaining portion of bore 36. A pair of identical inner seals 59 are located in land 57. One of the inner seals 59 may be considered a primary seal, normally the upper one, and the other a test seal. Inner seals 59 are positioned to engage an external seal area 60 on the outer diameter of inner member 27. External seal area 60 is a smooth cylindrical area. A test passage 61 extends from the exterior of outer member 35 to a point between the inner seals 59. The entrance of test port 61 is in the external seal area 51 of outer member 35.

FIG. 1 shows a casing running tool 63 installing immediate casing 25. Casing running tool 63 has an outer sleeve 65 which is supported by conduit 67 that will be lifted by the drilling rig. An inner sleeve 69 locates in outer sleeve 65. Inner sleeve 69 is connected by threads at its lower end to threads 33 of casing hanger inner member 27. Inner sleeve 69 has torque keys 71 located between it and outer sleeve 65. Torque keys 71 are aligned to match with milled slot 73 formed in the upper end of the casing hanger inner member 27. A J-pin 75 allows the outer sleeve 65 to be moved downward from the upper position shown on the left side to the lower position shown on the right side. When doing so, outer sleeve 65 will force torque keys 71 inward to engage slots 73. When in the lower position, rotation of conduit 67 will rotate casing hanger inner member 27 and casing 25. Load carrying teeth 76 are located between the inner sleeve 69 and outer sleeve 65.

Briefly explaining the operation of running casing 25, inner sleeve 69 is secured to threads 33 and the torque keys 71 are aligned with slot 73. The outer sleeve 65 is then lowered, forcing the torque keys 71 inward into the slots 73. Conduit 67 is then rotated approximately 45 degrees left-hand. This engages load carrying teeth 76 between the inner sleeve 69 and outer sleeve 65. The casing string 25 can now be picked up with the load passing through the teeth 76. The torque keys 71 allow rotation of the casing 25 to open and close the mudline latch tool (not shown) on the lower end of casing 25.

Casing running tool 63 is then released from casing hanger inner member 27 by applying the weight of conduit 67, which moves the J-pin 75 to the bottom of the J-slot (not shown). Then right-hand rotation and lifting upward will lift the outer sleeve 65, releasing the torque keys 71. Further right-hand rotation unscrews the inner sleeve 69 from threads 33. Casing running tool 63 will removed, leaving casing hanger inner member 27 and outer member 35 as shown in FIG. 1. Outer member 35 will be spaced above load shoulder 45 at this point.

Figure 2A:
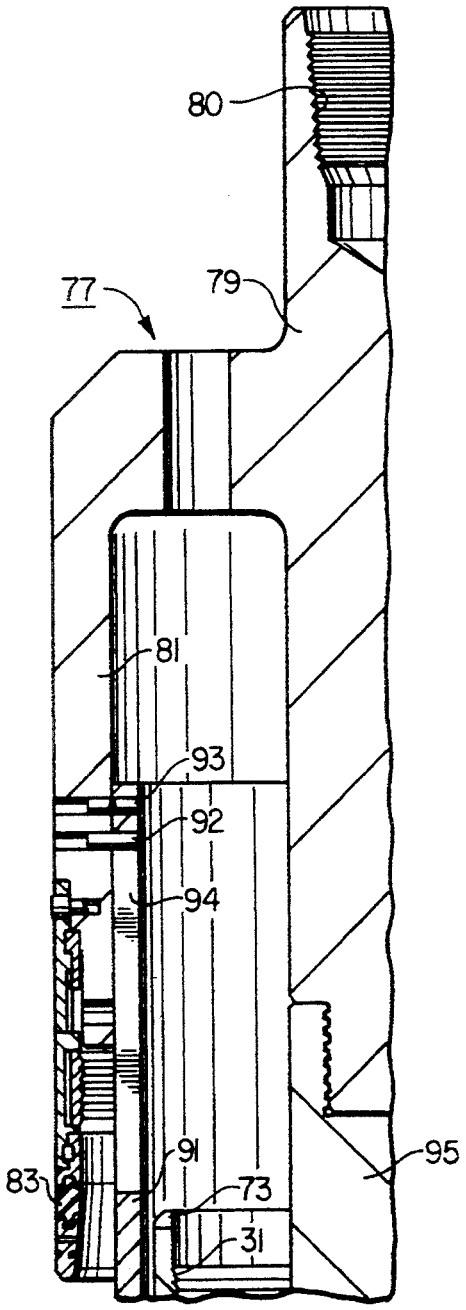
FIGS. 2A and 2B make up a partial vertical sectional view of the two-piece casing hanger of FIG. 1, and show a seal running tool in an initial position for installing an outer seal around the two-piece casing hanger.

The next step is illustrated in FIGS. 2A and B. A seal running and casing tensioning tool 77 is then lowered over the casing hanger inner and outer members 27, 35. Seal running tool 77 has a body 79 with threads 80 at its upper end for securing to conduit (not shown). An outer sleeve 81 is integrally formed with body 79 and extends downward. An outer casing hanger packoff or seal 83 is releasably carried by outer sleeve 81. Outer seal 83 is of a prior art type, and it is set by conventional techniques. Referring to the larger scale drawing of FIG. 8, outer seal 83 is a combination metal and elastomer, having a metal body **83*a* which has upper and lower portions. An elastomeric primary outer seal 83*b* is carried between the upper and lower portions of metal body 83*a*. An O-ring outer test seal 83*c* is located on the lower portion of metal body 83*a* below primary outer seal 83*b*. A radial communication passage 84 extends through the lower portion of metal body 83*a* between primary outer seal 83*b* and test seal 83*c*. Communication passage 84 communicates with the test passage 61 in casing hanger outer member 35, and also with a test passage 86 formed in casing head 15**.

Outer seal 83 is carried, set and retained by a retainer nut 85 which remains with the installation after the running tool 77 is removed. Retainer nut 85 is coupled to outer seal 83 through a split retainer ring 90, which allows rotation of retainer nut 85 relative to outer seal 83. Retainer nut 85 carries on its inner diameter a split internally threaded ring 88 which ratchets and engages external locking threads 53 on outer member 35. A key (not shown) prevents retainer nut 85 from rotating relative to threaded ring 88. Retainer nut 85 has circumferentially spaced J-slots **85*a* (FIG. 5) on its upper rim. Each J-slot 85*a*** has an axial portion for transmitting rotation and has a circumferential portion for use with a retrieval tool (not shown).

Torque keys 87 secured to outer sleeve 81 extend straight downward and enter the axial portions of J-slots 85a for transmitting rotation to the retainer nut 85. The torque keys 87 extend through slots in a protective sleeve which is not shown and is mounted to outer sleeve 81. The torque keys 87 are straight members which do not engage the circumferential portion of J-slots **85*a*, rather only the axial portions of J-slots 85*a***.

Figure 5:
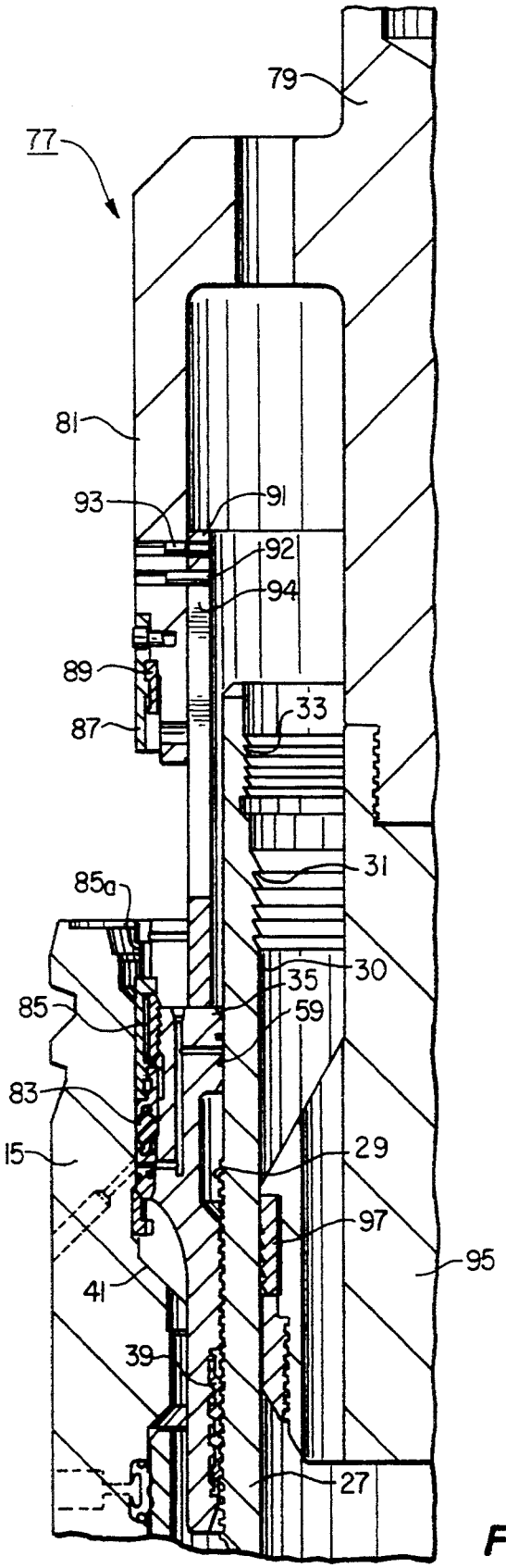
FIG. 5 is a partial vertical sectional view showing the seal running tool of FIG. 2 being released from the outer seal.
Figure 6A:
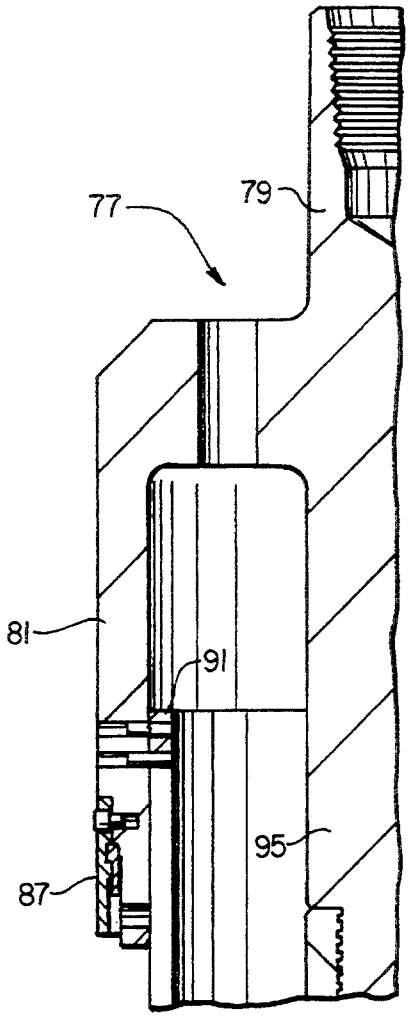
FIGS. 6A and 6B are a partial sectional view showing the mandrel of the seal running tool of FIG. 2 applying tension to the inner casing.
Figure 6B:
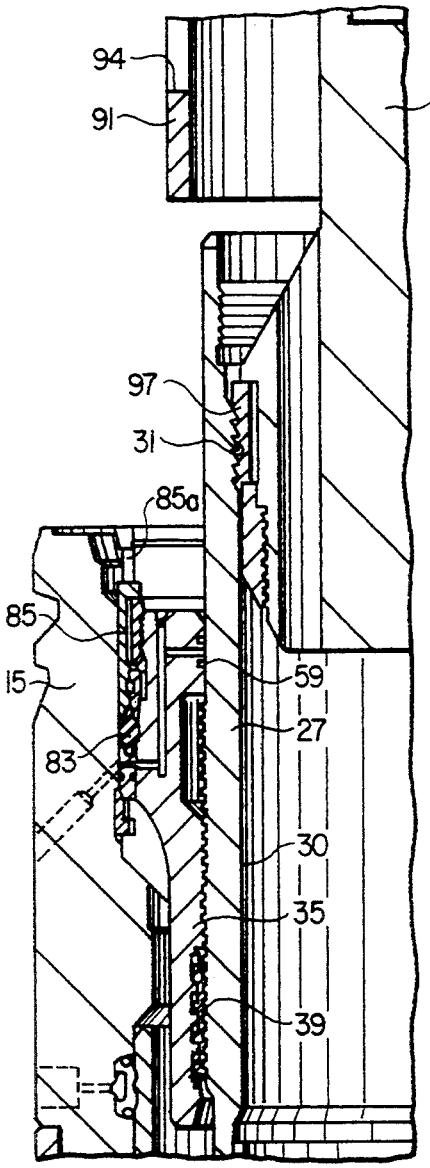

A collet 89 is secured to the running tool outer sleeve 81 by the same protective sleeve (not shown) that supports the torque keys 87. Collet 89 serves to releasably carry the retainer nut 85 and thereby the outer seal 83. Collet 89 is a sleeve with a plurality of slits (not shown) to allow radial flexibility. Collet 89 has an external circumferential rib which frictionally engages an annular groove in the inner diameter of retaining nut 85 near its upper rim. Rotation of outer sleeve 81 will tighten retainer nut 85 through torque keys 87 to set and retain outer seal 83. A straight upward pull on outer sleeve 81 pull causes the rib on the collet 89 to release from retainer nut 85 and cause torque keys 87 to pull from the J-slots **85*a* in retainer nut 85. FIGS. 5 and 6B** show the released position.

Figure 2B:
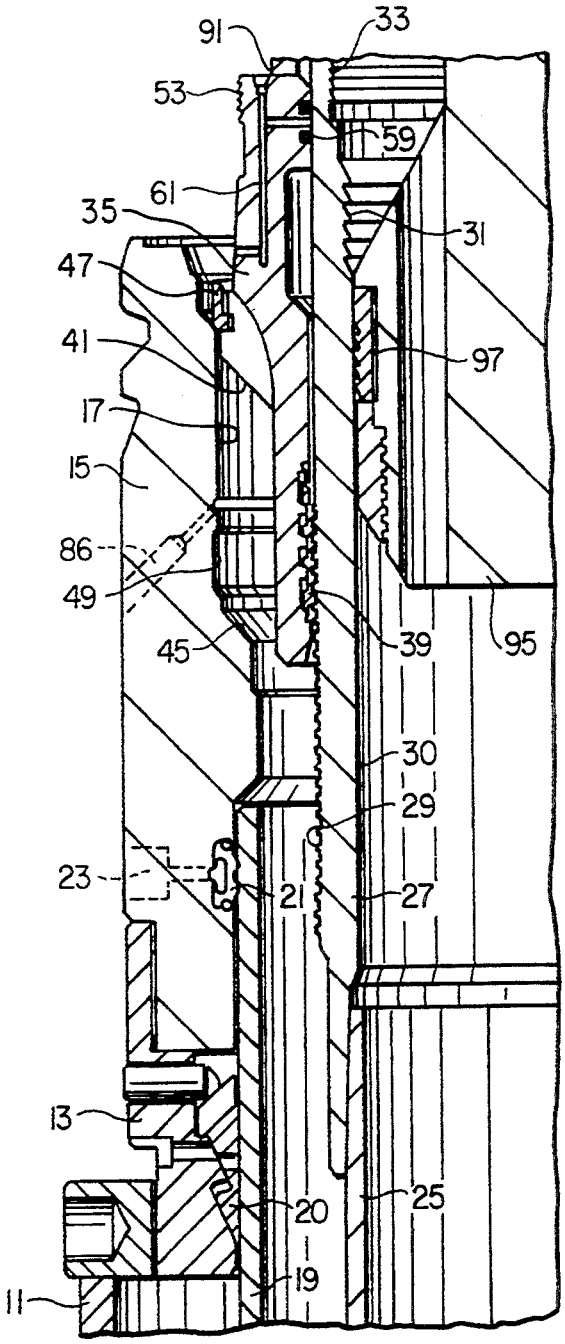

Referring again to FIGS. 2A and 2B, seal running tool 77 also has an inner sleeve 91 carried on the inner diameter of outer sleeve 81. Inner sleeve 91 has a lower end that will abut the upper end of casing hanger outer member 35. Inner sleeve 91 is secured by shear pins 93 to outer sleeve 81. Shear pins 93 serve as means to carry outer sleeve 81 in an upper position initially relative to inner sleeve 91, then allow it to move to the lower position shown in FIG. 4 after shearing. Inner sleeve 91 has a plurality of elongated axial slots 94 which receive retainer pins 92 to retain the inner sleeve 91 with the outer sleeve 81.

Referring again to FIGS. 2A and 2B, seal running tool 77 also has a mandrel 95 that extends downward along the axis of body 79. Mandrel 95 is adapted to slide within the bore 30 of casing hanger inner member 27. Mandrel 95 has a gripping ring 97 which is split and biased outward. Gripping ring 97 will slide freely downward past lifting grooves 31 because lifting grooves 31 and the teeth or threads of gripping ring 97 are saw-toothed and inclined to allow downward movement. Mandrel 95 can also move freely upward with gripping ring 97 sliding on bore 30 until the teeth of gripping ring 97 fully contact and mesh with the lifting grooves 31. The teeth of gripping ring 97 are configured so that they will not spring outward into engagement with lifting grooves 31 until fully aligned with all of the teeth or grooves of gripping ring 97 meshing with all of the lifting grooves 31.

Figure 3:
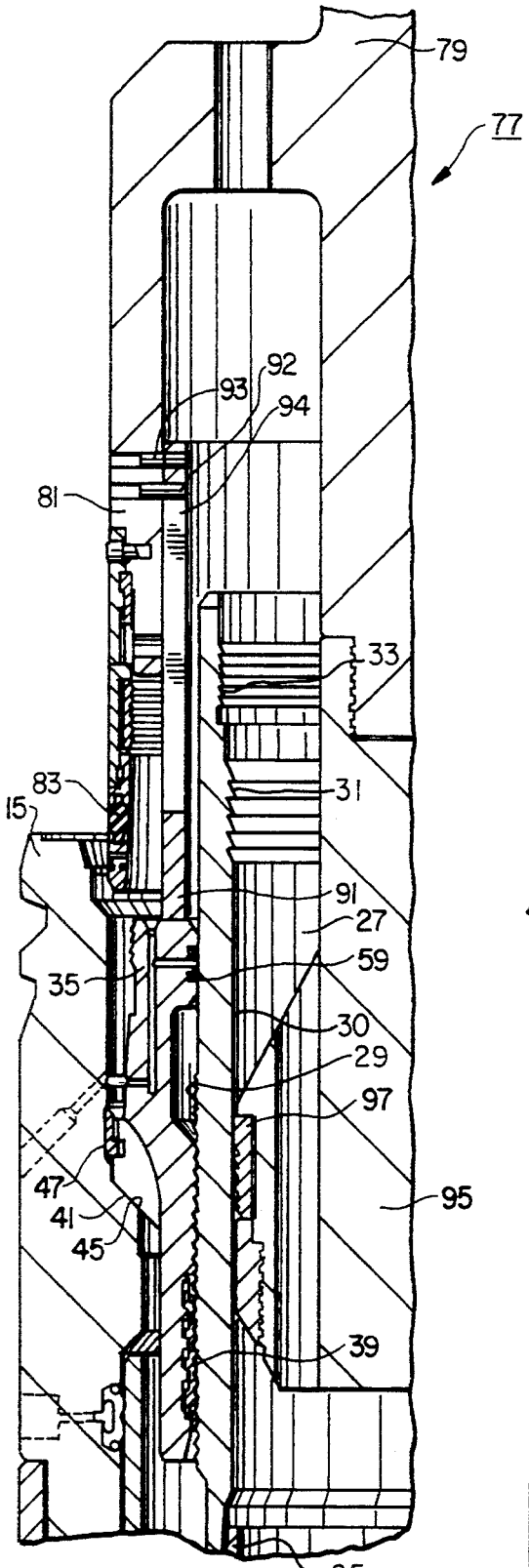
FIG. 3 is a partial vertical sectional view showing the seal running tool of FIG. 2 pushing the outer member of the two-piece casing hanger down onto the load shoulder of the casing head.

In the operation for installing the outer seal 83, the well assembly will appear as in FIG. 1, except that running tool 63 will have been removed. Inner member 27 of the casing hanger protrudes above the casing head 15. Outer member 35 of the casing hanger is located in an upper position, with its landing shoulder 41 spaced above the casing head load shoulder 45. The operator then secures outer seal 83 to seal running tool 77 and a conduit to threads 80 of seal running tool 77 (FIG. 2A). The operator then lowers the running tool 77 so that inner sleeve 91 will contact the upper end of casing hanger outer member 35, shown in FIGS. 2A and 2B. Mandrel 95 will locate within bore 30 of inner member 27. This is the position shown in FIGS. 2A and 2B. Continued downward movement will push outward member 35 downward until its landing shoulder 41 engages load shoulder 45. Retainer ring 47, being inward biased, will not yet be in engagement with recess 49. This is the position shown in FIG. 3. During the downward movement, latch ring 39 ratchets on the external threads 29.

Figure 4:
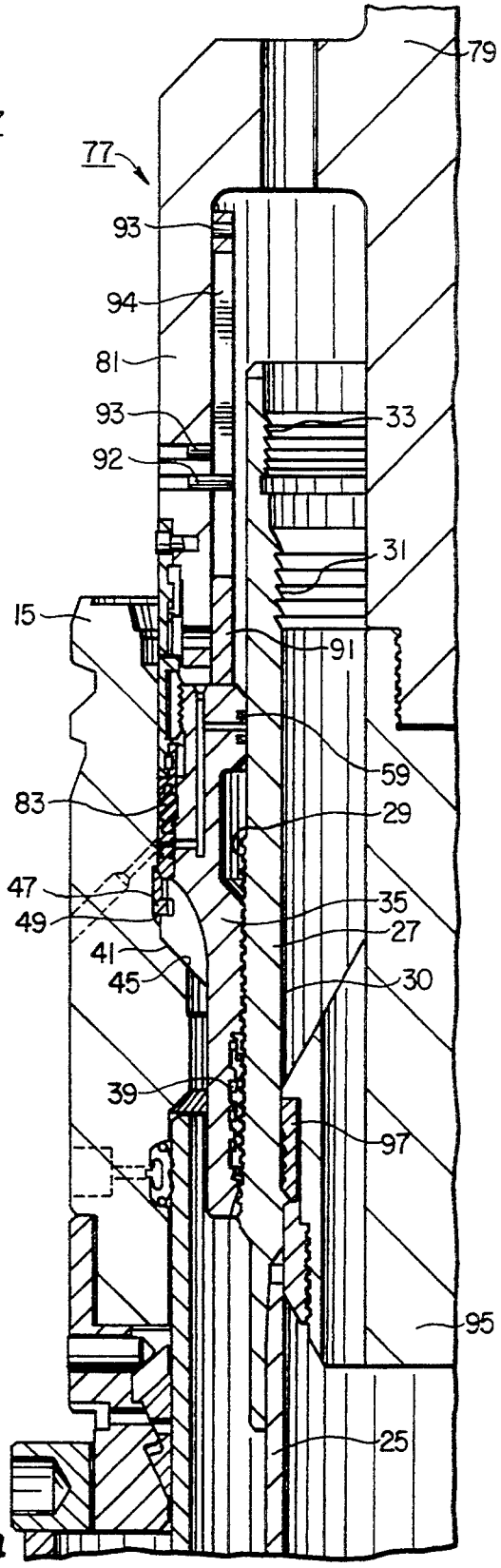
FIG. 4 is a partial vertical sectional view showing the outer seal the seal running tool of FIG. 2 positioning the outer seal between the outer member of the two-piece casing hanger and the casing head.
Figure 8:
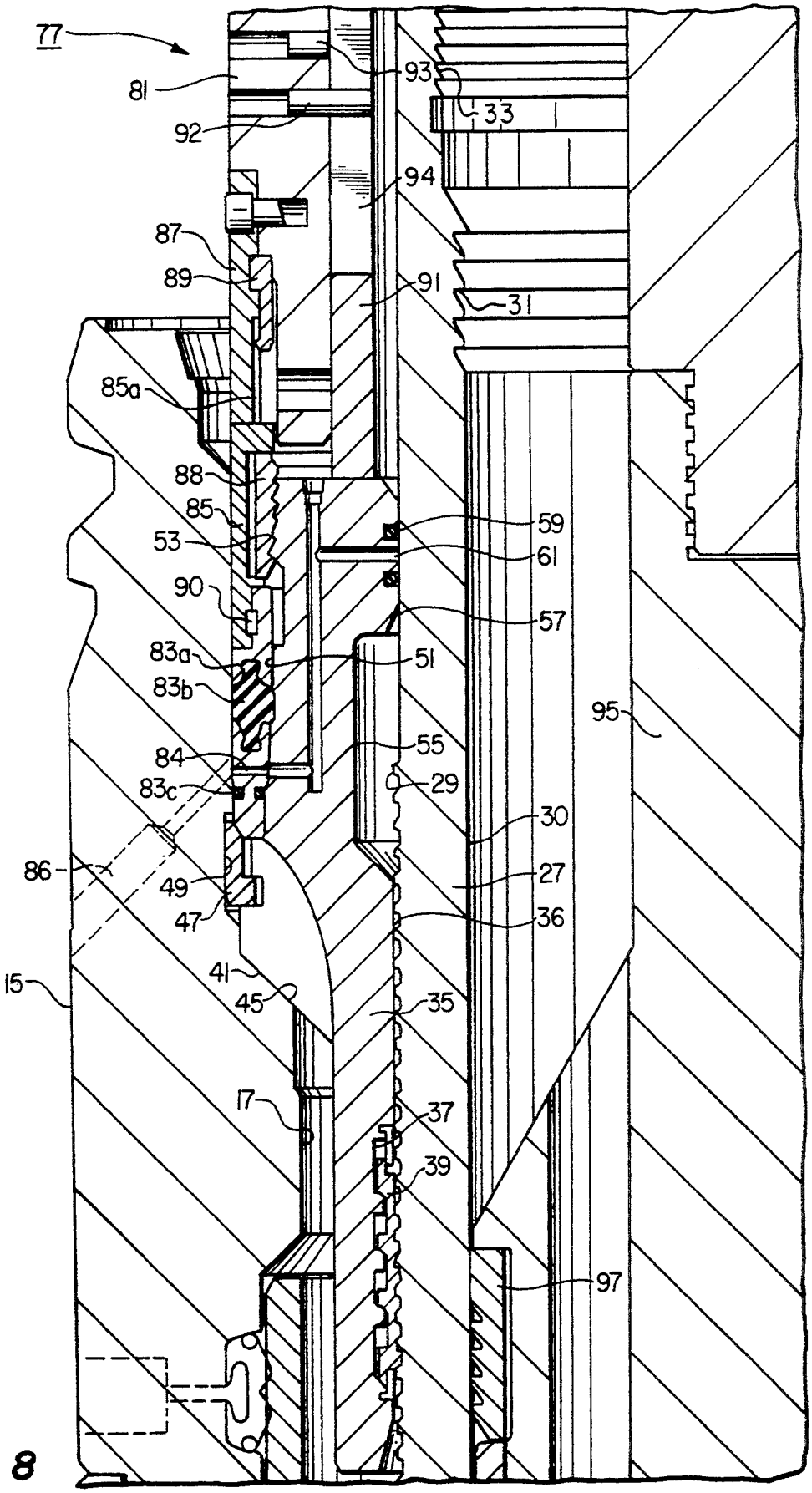
FIG. 8 is an enlarged partial sectional view of the system in the position shown in FIG. 4.

Then, referring to FIG. 4, the weight of the conduit on outer sleeve 81 of seal running tool 77 causes shear pins 93 to shear. Outer sleeve 81 will then move downward to the position shown in FIG. 4. Outer seal 83 will enter the pocket between the casing hanger outer member 35 and the bore 17 of casing head 15. The lower end of outer seal 83 will push the retainer ring 47 out into engagement with recess 49, locking the outer member 35 to the casing head 15. Referring also to FIG. 8, outer seal 83 will be in an initial sealing engagement with outer member external seal area 51. During the downward movement of outer seal 83, threaded ring 88 will ratchet and engage the locking threads 53. Then, the operator rotates the running tool 77 to fully sets the outer seal 83. The threaded ring 88 rotates with retainer nut 85 while outer seal 83 and outer member 35 remain stationary. This rotation applies additional torque and causes the outer seal 83 to fully set.

The inner and outer seals 59, 83 can be tested at this point by applying fluid pressure to test passage 86. The test fluid flows through test passage 86, communication passage 84 and into test passage 61. The fluid acts between the two inner seals 59. Also, the pressure acts between the primary outer seal **83*b* and test outer seal 83*c*. If the pressure holds, this indicates that all the various seals have properly sealed. The inner and outer seals 59, 83 combine to seal the annulus surrounding casing 25**.

Seal running tool 77 is released by pulling straight upward. The rib of collet 89 snaps loose from the groove within the retainer nut 85. The torque keys 87 move straight upward from J-slots **85*a* in retainer nut 85. This is the position shown in FIG. 5**.

As the body 79 of seal running tool 77 moves upward, mandrel 95 will move upward, with gripping ring 97 sliding up bore 30 of casing hanger inner member 27. Once gripping ring 97 has fully aligned with lifting grooves 31, gripping ring 97 will spring outward and mesh. Continue upward movement then causes the casing hanger inner member 27 to move upward relative to casing hanger outer member 35, applying tension to casing 25. Latch ring 39 will ratchet on the external threads 29. This position is shown in FIG. 6B. When the desired amount of tension has been reached, the operator can rotate to secure the latch ring 39, which will hold the tension in casing 25, transmitting the load to the outer member 35 and from there to the casing head 15. The running tool 77 is released from the casing hanger inner member 27 by rotation of the seal running tool 77. This results in the gripping ring 97 unscrewing from the lifting threads 31.

At this point, the operator will then install another casing head (not shown) on top of casing head 15. The operator will install a string of inner casing (not shown), normally $9\frac{5}{8}$ inch in diameter. The same type of two-piece casing hanger with inner and outer ratcheting members will be employed. The same steps will made as previously discussed.

The invention has significant advantages. Both of the inner and intermediate casing strings can be run, landed, tensioned and sealed through the blowout preventer. No rotation or vertical lifting of the casing head is required to bring the load shoulder in the head into contact with the landing shoulder of the casing hanger. The annulus seals may be tested by an external test port in the wellhead because the position of the casing hanger outer member is accurately known once landed in the casing head. This allows testing of the inner and outer seals prior to the next casing head being fitted. The seal running tool not only runs the outer seal, but also applies tension to the inner casing in the same run.

While the invention has been shown only one of its forms should be skilled in the art that it is not so limited but is susceptible to various changes without departing from the scope of the invention.

We claim:

1. An apparatus for supporting a string of casing extending between a subsea floor location and a surface casing head, the casing head having a bore with an internal load shoulder, comprising in combination:

a tubular inner member having an external seal area and a lower end which secures to an upper end of the casing;

an outer member having a bore which receives the inner member and an external downward facing shoulder which lands on the load shoulder of the casing head, the outer member having an external seal surface located above the downward facing shoulder;

a primary outer seal which seals between the bore of the casing head and the external seal surface of the outer member after the outer member has landed on the load shoulder;

engaging means between the inner and outer members for allowing the inner and outer members to be moved axially relative to each other to apply tension to the casing and for supporting the casing in tension with the outer member landed on the load shoulder; and inner seal means engaging the external seal area of the inner member and cooperating with the outer seal to seal an annulus surrounding the casing.

2. The apparatus according to claim 1, wherein the inner seal means comprises:

a primary inner seal in the bore of the outer member which sealingly engages the external seal area of the inner member.

3. The apparatus according to claim 1, wherein the inner seal means comprises:

a radially inward protruding land in the bore of the outer member; and a primary inner seal in the land of the outer member which sealingly engages the external seal area of the inner member.

4. The apparatus according to claim 1 wherein:

the engaging means includes a set of external grooves on the inner member;

the external seal area of the inner member is located above the external grooves; and the inner seal means comprises a primary inner seal in the bore of the outer member which sealingly engages the external seal area of the inner member.

5. The apparatus according to claim 1 wherein the engaging means comprises:

a set of external grooves on the inner member;

a set of internal grooves on the outer member;

a latch ring located between inner and outer members, having an inner diameter containing a set of internal grooves engaging with the external grooves of the inner member and an outer diameter containing a set of external grooves engaging the internal grooves on the outer member, the latch ring being radially expansible so as to ratchet as the inner member moves upward relative to the outer member; and wherein the external seal area is located above the external grooves; and the inner seal means comprises a primary inner seal in the bore of the outer member which sealingly engages the external seal area of the inner member.

6. The apparatus according to claim 1, wherein the inner seal means comprises:

a primary inner seal and a test inner seal axially spaced apart from each other in the bore of the outer member, the inner seals sealingly engaging the external seal area of the inner member; and wherein the apparatus further comprises:

an outer member test passage extending from an exterior portion of the outer member through the outer member to a point between the inner seals;

a casing head test passage extending from an exterior portion of the casing head through the casing head; and communication passage means communicating the casing head test passage with the outer member test passage for allowing test pressure to be applied between the inner seals to test the primary inner seal.

7. The apparatus according to claim 1, wherein the inner seal means comprises:

a primary inner seal and a test inner seal axially spaced apart from each other in the bore of the outer member, the inner seals sealingly engaging the external seal area of the inner member; and wherein the apparatus further comprises:

an outer member test passage extending from an exterior portion of the outer member through the outer member to a point between the inner seals;

a casing head test passage extending from an exterior portion of the casing head through the casing head;

an outer seal body which carries the primary outer seal;

a test outer seal carried by the outer seal body below the primary outer seal; and a communication passage extending through the outer seal body between the test outer seal and the primary outer seal and communicating the casing head test passage with the outer member test passage for allowing test pressure to be applied between the inner seals to test the primary inner seal as well as between the outer seals for testing the primary outer seal simultaneously.

8. In a well assembly which has a surface casing head having a bore with an internal load shoulder, a string of casing extending between a subsea floor location and the casing head, the improvement comprising in combination:

a tubular inner member having an external seal area and a lower end secured to an upper end of the casing;

an outer member having a bore which receives the inner member and an external downward facing shoulder which lands on the load shoulder of the casing head, the outer member having a cylindrical external seal surface located above the downward facing shoulder and spaced radially inward from the bore of the casing head;

a primary outer seal sealing between the bore of the casing head and the external seal surface of the outer member;

a set of external grooves on the inner member below the external seal area;

engaging means carried by the outer member and engaging the external grooves on the inner member for allowing the inner and outer members to be moved axially relative to each other to apply a selected amount of tension to the casing and for supporting the casing in tension with the outer member landed on the load shoulder; and a primary inner seal sealingly engaging the external seal area of the inner member, and cooperating with the primary outer seal to seal an annulus surrounding the casing.

9. The well assembly according to claim 8 further comprising:

a test inner seal, axially spaced from the primary inner seal;

test passage means for delivering a test fluid under pressure from exterior of the casing head to a point between the inner seals for testing the primary inner seal.

10. The well according to claim 8, wherein the primary inner seal is carried in the bore of the outer member.

11. The well assembly according to claim 8, wherein:

the outer member has a radially inward protruding land in the bore of the outer member; and wherein the primary inner seal is carried in the land of the outer member.

12. The well assembly according to claim 8, further comprising:

a test inner seal axially spaced from the primary inner seal and carried in the bore of the outer member;

an outer member test passage extending from an exterior portion of the outer member through the outer member to a point between the inner seals;

a casing head test passage extending from an exterior portion of the casing head through the casing head; and communication passage means communicating the casing head test passage with the outer member test passage for allowing test pressure to be applied between the inner seals to test the primary inner seal.

13. The well assembly according to claim 8 wherein the primary outer seal is carried by a seal body, and wherein the well assembly further comprises:

a test inner seal axially spaced the primary inner seal and carried in the bore of the outer member;

an outer member test passage extending from an exterior portion of the outer member through the outer member to a point between the inner seals;

a casing head test passage extending from an exterior portion of the casing head through the casing head;

a test outer seal located on the seal body and axially spaced from the primary outer seal; and a communication passage extending through the seal body of the outer seal between the outer seals and communicating the casing head test passage with the outer member test passage for allowing test pressure to be applied between the inner seals to test the primary inner seal as well as between the outer seals for testing the primary outer seal simultaneously.

14. The well assembly according to claim 8 wherein the engaging means comprises:

a set of internal grooves on the outer member;

a latch ring located between inner and outer members, having an inner diameter containing a set of internal grooves engaging with the external grooves of the inner member and an outer diameter containing a set of external grooves engaging the internal grooves on the outer member, the latch ring being radially expansible so as to ratchet as the inner member moves upward relative to the outer member; and wherein the primary inner seal is carried in the bore of the outer member.

15. In a well assembly which has a surface casing head having a bore with an internal load shoulder, a string of casing extending between a subsea floor location and the casing head, the improvement comprising in combination:

a tubular inner member having an external seal area and a lower end secured to an upper end of the casing;

an outer member having a bore which receives the inner member and an external downward facing shoulder which lands on the load shoulder of the casing head, the outer member having a cylindrical external seal surface located above the downward facing shoulder and spaced radially inward from the bore of the casing head;

a retaining latch on the outer member which engages a recess provided in the bore of the casing head to retain the outer member on the load shoulder;

a primary outer seal sealing between the bore of the casing head and the external seal surface of the outer member;

a set of external grooves on the inner member below the external seal area;

a set of internal grooves on the outer member;

a latch ring located between inner and outer members, having an inner diameter containing a set of internal grooves engaging with the external grooves of the inner member and an outer diameter containing a set of external grooves engaging the internal grooves on the outer member, the latch ring being radially expansible so as to ratchet as the inner member moves upward relative to the outer member to apply tension to the casing and for supporting the casing in tension with the outer member landed on the load shoulder; and a primary inner seal carried in the bore of the outer member and sealingly engaging the external seal area of the inner member, thereby cooperating with the primary outer seal to seal an annulus surrounding the casing.

16. The well assembly according to claim 15, wherein:

the outer member has a radially inward protruding land in the bore of the outer member; and wherein the primary inner seal is carried in the land of the outer member.

17. The well assembly according to claim 15 wherein the primary outer seal is carried by a seal body, and wherein the well assembly further comprises:

a test inner seal axially spaced from the primary inner seal and carried in the bore of the outer member;

an outer member test passage extending from an exterior portion of the outer member through the outer member to a point between the inner seals;

a test outer seal located on the seal body and axially spaced from the primary outer seal;

a casing head test passage extending from an exterior portion of the casing head through the casing head; and a communication passage extending through the seal body of the outer seal between the outer seals and communicating the casing head test passage with the outer member test passage for allowing test pressure to be applied between the inner seals to test the primary inner seal as well as between the outer seals for testing the primary outer seal simultaneously.

18. A method for supporting a string of casing extending between a subsea floor location and a surface casing head, the casing head having a bore with an internal load shoulder, the method comprising:

providing a tubular outer member having a bore and an external downward facing shoulder and an external seal surface above the downward facing shoulder;

providing a tubular inner member with an external seal area, placing the inner member in the outer member and securing the inner member to an upper end of the casing;

landing the downward facing shoulder of the outer member on the load shoulder of the casing head;

placing an outer seal between the bore of the casing head and the external seal surface of the outer member after the outer member has landed on the load shoulder;

moving the inner and outer members axially apart from each other to apply tension to the casing, and supporting the casing in tension with the outer member landed on the load shoulder; and sealing with an inner seal the external seal area of the inner member so as to seal an annulus surrounding the casing in cooperation with the outer seal.

19. The method according to claim 18, wherein the step of sealing the external seal area of the inner member comprises placing the inner seal between the bore of the outer member and the external seal area of the inner member.

20. The method according to claim 18 wherein the step of moving the inner and outer members axially apart from each other comprises:

placing a ratcheting latch ring between the inner and outer members which allows straight upward movement of the inner member relative to the outer member but prevents downward movement of the inner member relative to the outer member.

21. The method according to claim 18, further comprising:

applying a test pressure below the inner seal and the outer seal to simultaneously test the inner and outer seals.

22. In a well assembly which has a surface casing head having a bore with an internal load shoulder, a string of casing extending between a subsea floor location and the casing head, the improvement comprising in combination:

a tubular inner member secured to an upper end of the casing, and having at least one lifting groove within a bore of the inner member;

an outer member having a bore which receives the inner member and an external downward facing shoulder which lands on the load shoulder of the casing head, the outer member having a cylindrical external seal surface located above the downward facing shoulder and spaced radially inward from the bore of the casing head;

an outer seal sealing between the bore of the casing head and the external seal surface of the outer member;

engaging means carried by the outer member engaging the external grooves on the inner member for allowing the inner and outer members to be moved axially relative to each other to apply tension to the casing and for supporting the casing in tension with the outer member landed on the load shoulder; and a retrievable running tool which engages the inner and outer members for setting the outer seal and applying tension to the casing, comprising:

a body adapted to be connected to a string of conduit;

an inner sleeve carried by the body and which is adapted to contact an upper end of the outer member to push the outer member downward onto the load shoulder with the weight of the conduit;

an outer sleeve carried by the body around the inner sleeve, the outer sleeve releasably carrying the outer seal prior to its installation and being carried in an upper position relative to the inner sleeve initially;

means for retaining the outer sleeve in the upper position and for causing the outer sleeve to move to a lower position relative to the inner sleeve after the inner sleeve moves the outer member onto the load shoulder, the seal positioning against the external seal surface of the outer member when the inner sleeve moves to the lower position;

a gripping member depending downward from the body into the bore of the inner member as the inner sleeve engages and moves the outer member downward; and wherein subsequent upward movement of the body by the conduit after the outer seal has set moves the gripping member upward into engagement with the lifting groove of the inner member, causing the inner member to move upward relative to the outer member to apply tension to the casing.

23. The well assembly according to claim 22, further comprising an inner seal which engages an external seal area on the inner member to seal an annulus surrounding the casing in cooperation with the outer seal.

* * * * *